US005143564A

United States Patent [19]

Gruzleski et al.

[11] Patent Number: 5,143,564

[45] Date of Patent: Sep. 1, 1992

[54] LOW POROSITY, FINE GRAIN SIZED STRONTIUM-TREATED MAGNESIUM ALLOY CASTINGS

[75] Inventors: John E. Gruzleski, Pointe Claire; Abdulcelil Aliravci, Ste. Foy, both of Canada

[73] Assignee: McGill University, Montreal, Canada

[21] Appl. No.: 676,819

[22] Filed: Mar. 28, 1991

[51] Int. Cl.[5] ..... C22C 23/00; C22F 1/00

[52] U.S. Cl. ..... 148/420; 148/536; 420/402; 420/406; 420/409; 420/590; 164/122.1

[58] Field of Search ..... 148/420, 3; 420/402, 420/406, 409, 590

[56] References Cited

U.S. PATENT DOCUMENTS 3,119,725 1/1964 Foerster ..... 420/409
3,290,742 12/1966 Petrovich ..... 148/420
4,729,874 3/1988 Meyer-Grünow ..... 420/590
4,886,557 12/1989 Chadwick ..... 148/3

OTHER PUBLICATIONS

Magnesium-Strontium Binary Phase Diagram, in Binary Alloy Phase Diagrams, ASM 1986, (eds.) Massalski et al., pp. 1549-1550.

Kubichek, L. Izy, V.U.Z. Tsvetnaya Met 2 (1959), pp. 154-157, (with French translation).

*Primary Examiner*—Upendra Roy
*Attorney, Agent, or Firm*—Bachman & LaPointe

[57] ABSTRACT

Cast magnesium alloy parts being substantially free of microporosity and having a fine grain size are produced by addition of strontium in an amount of 0.001 to 0.1%, by weight, to the melt of the magnesium alloy, prior to casting; the addition of strontium effects a reduction in the grain size and concentrates the shrinkage microporosity, whereby the microporosity can be shifted by conventional techniques to an appendix of the casting which is subsequently removed.

19 Claims, 10 Drawing Sheets

DENSITY PLOTS FOR RISERED CAST BARS AT 0% Sr AND OPTIMUM LEVEL Sr

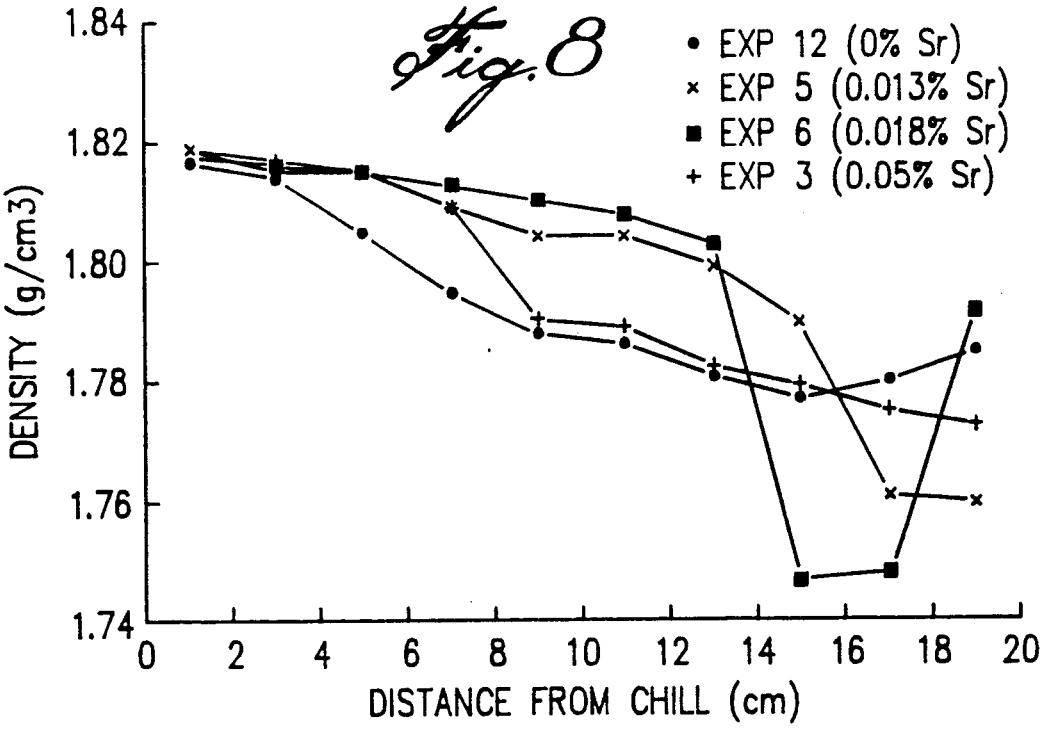
DENSITY CURVES FOR Mg ALLOY TEST BARS SAND-CAST WITH DIFFERENT Sr CONTENTS.
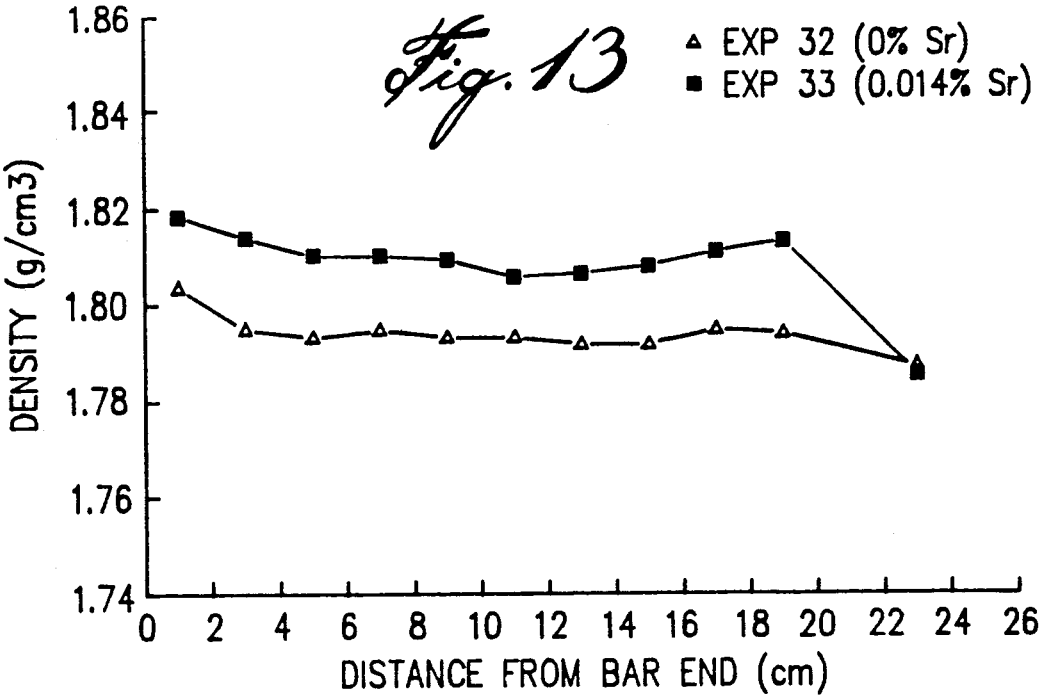
DENSITY PLOTS FOR RISERED CAST BARS AT 0% Sr AND OPTIMUM LEVEL Sr.

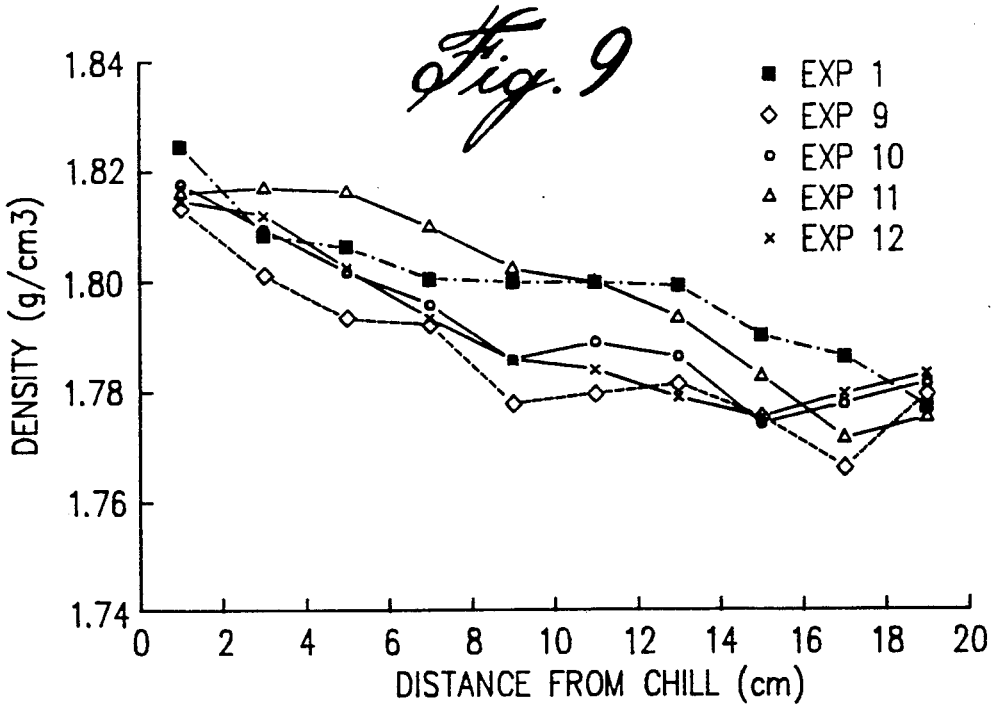
DENSITY CURVES FOR Mg ALLOY TEST BARS ALL SAND-CAST WITH 0% Sr CONTENT.
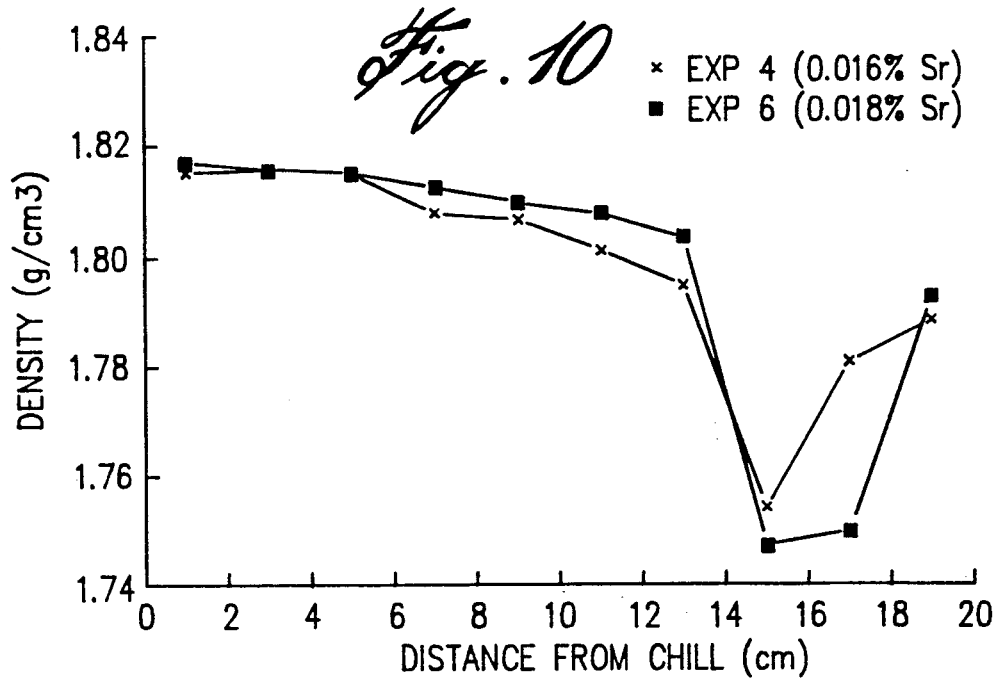
DENSITY CURVES FOR Mg ALLOY TEST BARS SAND-CAST WITHIN THE OPTIMUM Sr CONCENTRATION RANGE.

SUMMARY GRAPH: PLOTTED FROM THE AVERAGE VALUES OF 0% Sr AND OPTIMUM LEVEL Sr.

RISERED AND CHILLED BAR CASTING

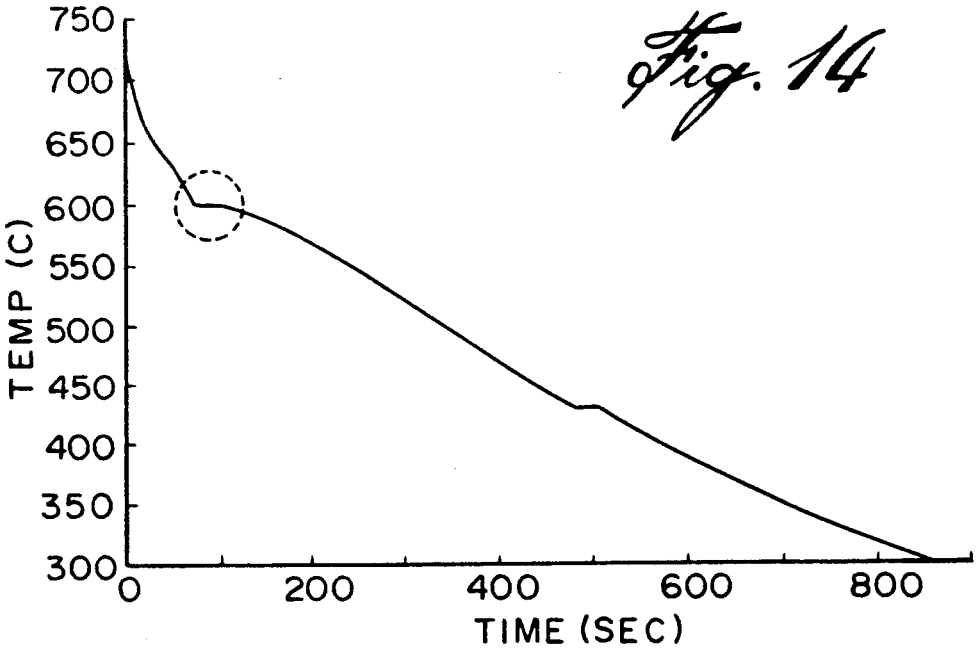
COOLING CURVE OF SAMPLE I (0% Sr).
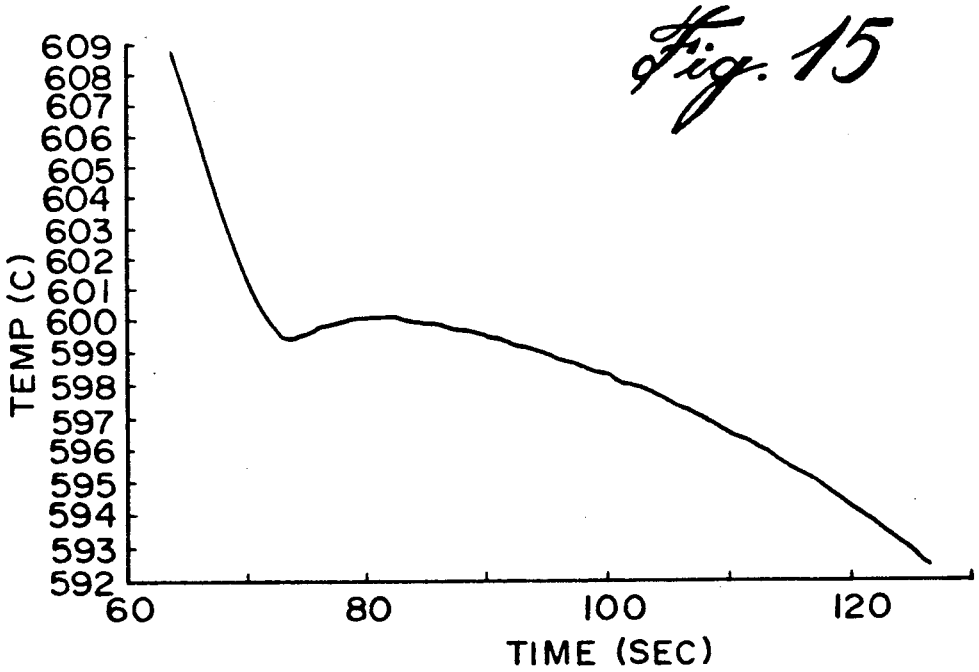
ENLARGED LIQUIDUS-ARREST PORTION OF THE COOLING-CURVE OF SAMPLE I.

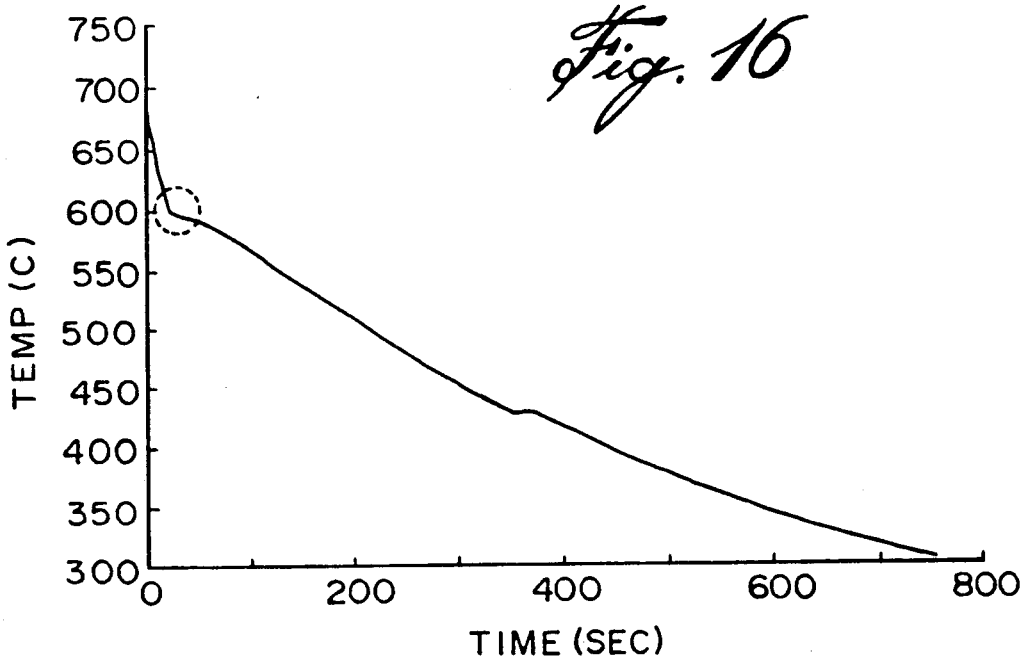
COOLING CURVE OF SAMPLE 2 (0.013% Sr).
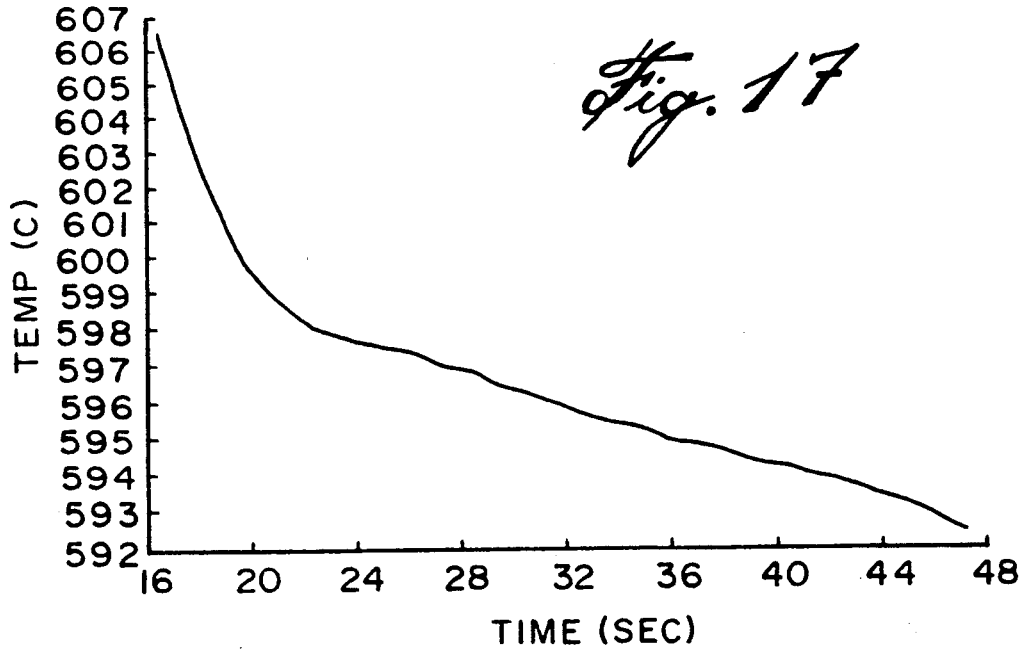
ENLARGED LIQUIDUS-ARREST PORTION OF THE COOLING-CURVE OF SAMPLE 2.

RELATIONSHIP BETWEEN COOLING-CURVE LIQUIDUS-ARRESTS AND GRAIN SIZE.

LOW POROSITY, FINE GRAIN SIZED STRONTIUM-TREATED MAGNESIUM ALLOY CASTINGS

BACKGROUND OF THE INVENTION

1. Field of the Invention

This invention relates to case magnesium alloys of low porosity and fine grain size and their method of production.

2. Description of Prior Art

Magnesium alloys are widely used engineering materials, for example, as cast parts in the aerospace and automobile industries. The magnesium alloys have a low specific gravity, typically about 1.8 g/cm$^3$, and their light weight and relatively high strength provide a high strength-to-weight ratio.

Particularly advantageous properties of magnesium alloys include low density, high strength-to-weight ratio, good castability, easy machinability and good damping characteristics.

Magnesium alloy parts can be produced by the conventional casting methods including diecasting, sand casting, permanent and semi-permanent mold casting, shell casting and investment casting.

An especially useful class of magnesium alloy for cast parts, is that based on magnesium with minor amounts of aluminum and zinc and optionally manganese as alloying additions.

Magnesium alloys have experienced a rapid growth in use in cast parts in the automobile industry as a result of general requirements for lighter weight automobiles to conserve energy.

A particular disadvantage of the cast magnesium alloys is their relatively coarse grain size, typically about 225 μm which results in reduction of tensile strength, ductility and pressure tightness of the alloy part as compared with a hypothetical magnesium alloy of fine grain size. The coarse grain size also results in an undesirable microporosity.

A further disadvantage, which seems to be especially characteristic of the aforementioned magnesium alloys based on magnesium, aluminum and zinc and optionally manganese, is the tendency of the alloy part to develop shrinkage microporosity during casting.

The conventional approach to reducing shrinkage microporosity in alloys involves the use of risers in combination with chilling during casting to promote directional solidification towards the riser whereby the shrinkage microporosity shifts towards the riser which forms a removable appendix to the main portion of the casting. In the case of the magnesium alloys, however, it is difficult to produce magnesium alloy parts free of shrinkage microporosity on a consistent basis, especially when the alloy solidifies over a long freezing range, which is the case with the aforementioned alloys based on magnesium, aluminum, zinc and manganese.

SUMMARY OF THE INVENTION

It is an object of this invention to provide a method of producing a cast magnesium alloy part of reduced shrinkage microporosity, or substantially free of shrinkage microporosity.

It is a further object of this invention to provide a method of producing a cast magnesium alloy part of fine grain size.

It is still a further object of this invention to provide a cast magnesium alloy part characterized by a fine grain size.

It is yet another object of this invention to provide a cast magnesium alloy part of reduced shrinkage microporosity, or substantially free of shrinkage microporosity.

In accordance with the invention it has been found that adding strontium to a molten melt of the magnesium alloy concentrates the shrinkage microporosity.

Furthermore, it has been found that adding strontium to a molten melt of the magnesium alloy produces a grain refinement during casting.

The presence of strontium in the melt has the effect of concentrating the shrinkage microporosity, whereby the concentrated microporosity can be shifted to the hottest part of the solidifying melt, remote from the cooling or chilling effect employed to solidify the melt. Thus the shrinkage microporosity can be concentrated in an appendix of the desired cast part, during casting. Consequently where a riser is provided in the casting the shrinkage microporosity can be consistently concentrated in the riser which forms an appendix to the main portion of the casting, which appendix can be removed to leave the desired main portion as the cast part.

In order to achieve these desired results the strontium is intimately dispersed throughout the molten melt of the magnesium alloy in an amount, in weight %, of 0.001 to 0.1, preferably 0.005 to 0.03%.

The cast part in accordance with the invention thus has a fine grain size typically of 75 to 150 um and is substantially free of microporosity by which is intended that the % porosity, by volume of the part is less than 0.75%, preferably less than 0.5%, and as low as 0.25%.

In a particular embodiment the casting step comprises contacting a melt of the alloy with at least one cooling surface and solidifying the melt in a direction away from the at least one cooling surface to effect concentration of the shrinkage microporosity developed during solidification, remote from the at least one cooling surface. In particular the cast part may comprise a main part and an appendix, the concentration of the microporosity being in the appendix, and including a step of removing the appendix to leave the main part as the desired casting substantially free of microporosity.

DESCRIPTION OF PREFERRED EMBODIMENTS

(a) Magnesium Alloy Parts

The magnesium alloy parts with which the invention is concerned are, in particular, cast parts produced by conventional casting techniques including die-casting, sand casting, investment casting, permanent mold casting, semi-permanent mold casting and shell casting.

Typical magnesium casting alloys are shown in Table 1, below:

TABLE 1

Nominal compositions of magnesium casting alloys

| | Element (wt. %) | | | | | | | |
|---|---|---|---|---|---|---|---|---|
| Alloy | Al | Zn | Mn | Rare earths | Th | Y | Zr | Si |
| AM100A | 10.0 | — | 0.1 min | — | — | — | — | — |
| AZ63A | 6.0 | 3.0 | 0.15 | — | — | — | — | — |
| AZ81A | 8.0 | 0.7 | 0.13 | — | — | — | — | — |
| AZ91C | 9.0 | 0.7 | 0.13 | — | — | — | — | — |
| AZ91E | 9.0 | 2.0 | 0.10 | — | — | — | — | — |

TABLE 1-continued

Nominal compositions of magnesium casting alloys

| Alloy | Element (wt. %) | | | | | | | |
|---|---|---|---|---|---|---|---|---|
| | Al | Zn | Mn | Rare earths | Th | Y | Zr | Si |
| AZ92A | 9.0 | 2.0 | 0.10 | — | — | — | — | — |
| EZ33A | — | 2.7 | — | 3.3 | — | — | 0.60 | — |
| HK31A | — | — | — | — | 3.3 | — | 0.70 | — |
| HZ32A | — | 2.1 | — | — | 3.3 | — | 0.70 | — |
| QE22A(a) | — | — | — | 2.0 | — | — | 0.60 | — |
| EQ21A(a,b) | — | — | — | 2.0 | — | — | 0.60 | — |
| ZE41A | — | 4.2 | — | 1.2 | — | — | 0.70 | — |
| ZE63A | — | 5.7 | — | 2.5 | — | — | 0.70 | — |
| ZH62A | — | 5.7 | — | — | 1.8 | — | 0.70 | — |
| ZK51A | — | 4.6 | — | — | — | — | 0.70 | — |
| ZK61A | — | 6.0 | — | — | — | — | 0.70 | — |
| WE54A | — | — | — | 3.50(c) | — | 5.25 | 0.50 | |
| AM60A | 6.0 | — | 0.13 | — | — | — | — | — |
| AS41A | 4.25 | — | 0.35 | — | — | — | — | 1.0 |
| AZ91A | 9.0 | 0.7 | 0.13 | — | — | — | — | — |
| AZ91B | 9.0 | 0.7 | 0.13 | — | — | — | — | — |
| AZ91D (HP)(e) | 9.0 | 0.7 | (d) | — | — | — | — | — |

(a) These alloys also contain silver, that is, 2.5% in QE22A and 1.5% in EQ21A.
(b) EQ21A also contains 0.10% Cu.
(c) Comprising 1.75% other heavy rare earths in addition to the 1.75% Nd present.
(d) Manganese content to be dependent upon iron content.
(e) The proposed alloy to have very low limits for iron, nickel, and copper.
(HP) High purity.

In an especially preferred embodiment the invention is concerned with magnesium alloys containing in wt. %, 4 to 10% Al, 0.5 to 6% Zn, 0 to 0.15% Mn, 0 to 3.5% rare earth elements, 0 to 3.5% Tn, 0 to 6% Y, 0 to 1% Zr and 0 to 1% Si, with the balance being magnesium.

In the magnesium casting alloys based on magnesium, aluminum and zinc, namely, the AZ91 series, the aluminum is the main alloying element and functions to increase the strength. The addition of zinc also provides some increase in tensile properties. Grain refinement can be achieved by carbon inoculation to obtain higher tensile, yield and fatigue strength as well as higher ductility and impact toughness.

The Mg-Al-Zn alloys of the AZ91 series have a microstructure of magnesium grains which in a microphotograph are white surrounded by regions of massive magnesium-aluminum compound ($Mg_{17}Al_{12}$) and dark patches of fine alternate layers of $Mg_{17}Al_{12}$ and α-Mg. A Mg-Al binary phase diagram demonstrates that a eutectic forms between the solid solution of aluminum in magnesium (α-Mg) and the intermetallic compound $Mg_{17}Al_{12}$. Due to the presence of zinc, the magnesium-aluminum eutectic takes a completely divorced form, in which massive particles of $Mg_{17}Al_{12}$ compound occur around the magnesium grains. These particles are brittle, and when such a metal is stressed, cracks develop in these regions and then proceed to propagate throughout the adjacent metal. A solution heat-treatment dissolves almost all the magnesium-aluminum compound and produces equiaxed grains of relatively uniform composition.

These alloys can be used in the as-cast (F) state where they have a tensile strength of about 24,000 psi (166 $N/mm^2$) with 2 0.2% yield strength of about half this value, and an elongation of only two per cent. However, very often these alloys are used in the solution heat-treated (T4) condition which gives considerably improved tensile strength and ductility together with good shock resistance. Full heat treatment (T6); a low temperature precipitation treatment (artificial aging) following solution heat-treatment, maintains the same tensile strength, gives an improved yield strength, but lowers the ductility.

With the development of foundry techniques for chilling and directional solidification, properties attainable in magnesium alloy castings have been steadily improved. However, the AZ91 alloy series still has a number of limitations, such as:

i) mechanical properties fall off rapidly above 120° C.,
ii) in the T6 condition the alloy shows susceptibility to stress corrosion cracking at stress levels above 50% of the yield strength of the alloy.
iii) the inherent tendency to serious shrinkage microporosity formation, which represents a major disadvantage.

The first two problems can be eliminated by using the alloy only for ambient temperature applications and in the T4 condition. However, to eliminate shrinkage microporosity completely on a consistent basis has not previously been possible; it can only be reduced to a certain level by the use of considerable skill and experience in addition to conventional risering and chilling techniques.

The microporosity is due essentially to unfed shrinkage in the alloy which solidifies over a large temperature range (≈170° C.), and it exhibits itself as tiny intergranular or interdendritic cavities dispersed throughout the entire casting. Those microshrinkage cavities are seen as black areas in micrographs of the alloy.

Since the porosity in Mg/Al/Zn alloys can often be a layer-type porosity also seen in many other long freezing-range alloys, and which is oriented approximately at right angles to the casting wall, the magnesium castings of these alloys are generally not pressure-tight. In addition, the presence of shrinkage microporosity impairs also the tensile, fatigue and impact properties. Therefore, especially for aircraft quality castings, the elimination of such a defect has always been given top priority.

(b) Strontium

At a level in the range of 0.005% to 0.03%, by weight, addition of strontium to a melt of the alloy has the surprising effect of concentrating the microporosity and reducing the grain size of the alloy part cast from the melt.

Strontium has the surprising effect of concentrating the shrinkage microporosity in the casting. Thus the use of the addition of strontium to concentrate the shrinkage microporosity, in conjunction with the technique of shifting the shrinkage microporosity to the hottest section of the casting permits the production of cast parts which are substantially free of shrinkage microporosity.

The addition of strontium also reduces the grain size in the cast part to a value in the range of 75 μm to 150 μm. This is to be contrasted with the grain size in the conventional cast magnesium alloy parts, which is usually greater than 225 μm.

The effect of Sr on the redistribution of shrinkage microporosity can be explained largely by improved intergranular feeding.

The critical stage in the control of shrinkage microporosity is the final period of solidification, i.e., after the alloy is about 70% solid and coherence has been established between growing crystals. At this stage, some of the feed channels may become too small for liquid metal to pass through them or feed channels may be blocked by impinging crystals or dentrite tips. In any case, small pools of liquid are cut off from further feeding and their shrinkage upon solidification results in shrinkage microporosity.

When intergranular channels are too small a pressure difference $\Delta P(P_a - P_L)$ develops and when it reaches a critically high value, intergranular shrinkage cavities form. Analytically this can be expressed as:

$$\Delta P = P_a - P_L = \frac{C_o \mu \lambda L^2}{r^4} \left( \frac{t^2}{\pi R^2 n} \right)$$

where:

$C_o$=a constant related to solidification contraction,
u=metal viscosity,
$\lambda$=heat flow constant,
t=tortuosity of channels,
R=casting radius,
r=radius of liquid channel.

As seen, r is a very important factor, since a change in r results in a fourth power change in the tendency to shrinkage formation. Other important factors in intergranular feeding are metal viscosity, $\mu$, and heat flow constant, $\lambda$.

The effect of Sr on intergranular feeding can be explained as follows:

i) at 0.005% to 0.3%, and preferably 0.01% to 0.02% Sr, the grain size of castings is reduced. This may be explained by an alteration (slowing down) in grain growth kinetics or an enhanced nucleation of grains in the liquid phase;
ii) slow grain growth keeps the liquid channel radius large during the final stages of solidification and results in improved intergranular feedings;
iii) slow grain growth results in delayed impingement of various grains, and hence, in delayed blocking of intergranular channels, i.e., an improved mass feeding.

The effect of Sr on growth kinetics can be explained by the poisoning of the grain surface or the poisoning of fast growing directions of the grains by preferential adsorption of Sr at these sites.

It is possible too that strontium may produce other effects such as decreased metal viscosity and/or decreased liquid surface tension and improved wettability of the intergranular channel walls. The last factor is the most likely to occur since Sr atoms adsorbed onto the growing crystals may change the solid/liquid interfacial energy.

The resultant effect of Sr addition in the preferred range of 0.005 to 0.03% is the reduction of shrinkage microporosity throughout the casting (except at the hottest section) via reduced grain growth rate, by keeping the liquid channel radius larger compared to that in the absence of strontium. This mechanism explains both the reduced grain size and reduced shrinkage microporosity.

Microporosity occurs only at the hottest sections where the solidification is locally delayed. If these hottest sections are driven into the risers via directional solidification, which can be achieved by proper casting design, as in risered castings, effective control of microporosity is achieved.

It is found that the effect of strontium in concentrating the microporosity disappears at elevated strontium levels as does the refinement in grain size, and the shrinkage porosity then becomes finely dispersed throughout the casting.

One possible explanation for the effect of elevated levels of strontium is that such amounts are above the solubility level of strontium in the alloy melt and a precipitated phase of Mg and Sr is formed which might become a preferential site for strontium atoms in the matrix, such that fewer strontium atoms are available to poison or hinder the growth of the grains.

Such poisoning by the excess strontium would result in the strontium being adsorbed on some grain surfaces probably in the fastest growing directions; and this would lead to the suppression of some stem growth directions. The net result would be less dendritic growth and this would inhibit the early blocking of the feed channels. Since grain growth is not slowed down as much as at optimum Sr levels, some shrinkage microporosity would form in the casting, but it would be mostly intergranular and less interdendritic.

(c) Microporosity

Microporosity is an extremely fine form of the well-known casting defect generally known as porosity. It appears on radiographic films as mottling. Porosity is the most common imperfection that occurs in metal castings, and is attributed to contraction that accompanies the freezing of the metal (shrinkage porosity); evolution of dissolved gases from the liquid during cooling and freezing (gas porosity), or a combination of the two phenomena.

All cast metals and alloys exhibit some form of shrinkage porosity due to solidification shrinkage. Solidification shrinkage is the contraction in the volume of the metal as it goes from a liquid state of disconnected atoms to a solid state of crystals of atoms and chemical compounds. As crystals grow, some of the feed channels may become too small for liquid metal to pass through them, or feed channels may be blocked by segregate particles. In any case, small pools of liquid are cut off from further feeding, and their shrinkage upon solidification results in porosity.

Knowledge of the solidification (freezing) mechanism of a molten metal or an alloy is especially important, because this mechanism controls the shape and distribution of shrinkage porosity. The mode of freezing depends mainly on the freezing range of the alloy, although freezing rate and grain refining also affect the mode of freezing to a significant extent. Freezing range is the range of temperatures between the liquidus and solidus of an alloy where liquid and solid constituents coexist. Pure metal and eutectic alloy compositions do not exhibit freezing ranges; while low alloy and near eutectic compositions have short freezing ranges and so are called short freezing-range alloys. On the other hand, alloy compositions where the distance between liquidus and solidus is large are called long freezing-range alloys.

When a molten pure metal or eutectic alloy is poured into a mold solidification begins at the mold wall and proceeds inward. The onset of freezing is marked by the nucleation of numerous tiny crystallites at sites on the mold wall. The more favourably oriented of these crystallites grow rapidly into the molten regions of the casting, quickly linking up with the adjacent crystallites to form a continuous front known as the solidification front. This solidification front is planar (smooth) in absolutely pure metals because the temperature of the liquid/solid interface is constant with only minor fluctuations. The front advances with a velocity ($V_i$) that is proportional to the cooling rate as given by the equation:

$$k_S(\delta T/\delta x)_S - k_L(\delta T/\delta x)_L = -Q_f V_i$$

where $k_S$ and $k_L$ are thermal conductivities in the solid and liquid, and $Q_f$ is the latent heat of fusion. When the advancing fronts meet in the center of the casting, the last liquid to solidify contracts and leaves behind a central shrinkage pipe.

The solidification of short freezing range alloys is similar except that due to the formation of dendrites because of constitutional supercooling at the liquid/-solid interface, the solidification front is not planar but serrated. When the advancing fronts meet at the center of the casting, the last liquid solidifies and upon contraction leaves behind pockets of centerline shrinkage.

The long freezing range alloys exhibit a totally different solidification mode. As before, freezing begins with the nucleation of crystallites on the mold walls. These initial crystallites are poorer in alloying elements due to the rejection of solute atoms into the surrounding liquid, and these solute atoms greatly enrich the liquid in these elements. This substantially lowers the freezing point of the liquid and the growth of the crystallites is temporarily halted. When the temperature of the casting falls slightly, a second cluster of crystallites nucleates just outside the enriched region. This process of nucleation and growth inhibition is repeated time and again until small crystallites have been nucleated through the entire volume of the casting. Freezing then continues by the gradual growth of all the crystallites simultaneously with some liquid still remaining around them. This is called pasty or mushy-state freezing. This process takes place simultaneously throughout the entire casting. When the last liquid around the crystallites freezes it contracts and leaves behind an intergranular shrinkage network known as shrinkage microporosity that is characteristic of alloys of long freezing-range.

Solidification shrinkage of long freezing range alloys is largely a feeding problem. In the initial stages of freezing, the primary crystals are free to move to some extent in the mixture of liquid and solid, that is the metal is still fluid, and the shrinkage which takes place as the crystallites grow is compensated by a fall in the level of this still fluid mass. Fluidity is maintained until the casting is approximately 70 percent solid. Towards the end of this period the mixture of solid and liquid becomes very sluggish, but shrinkage compensation by settling of the mass can still take place. This process has been termed mass feeding, and it compensates for roughly two-thirds of the total liquid-to-solid (freezing) shrinkage of the alloy. Thus, in the case of AZ91 alloys having a total freezing shrinkage of 5.10 per cent by volume, it would be expected that approximately 3.40 per cent out of the 5.10 per cent would be accounted for by mass feeding.

When approximately 70 per cent of the casting is solid, a stage is reached where the growing primary crystals have become so large that they interlock with each other and the casting begins to become rigid. At this stage mass feeding stops; thereafter the shrinkage of the remaining liquid must be compensated for by the flow of liquid into the casting through intergranular and interdendritic capillary channels. If such feeding is not perfect, the still growing dendrites compete with each other for the remaining liquid metal which is not isolated in numerous tiny pools scattered throughout the casting. As mentioned before, when the isolated pools of liquid eventually freeze they give rise to finely dispersed porosity which is called shrinkage microporosity.

Formation of gas porosity occurs by a nucleation and growth process. Homogeneous bubble nucleation occurs without the help of any foreign nuclei while heterogeneous nucleation occurs when some foreign nuclei such as inclusions, mold wall, or an existing gas bubble are present to aid the nucleation process.

Heterogeneous bubble nucleation is more important during the early stages of freezing and it becomes less probable during the later stages since the presence of foreign nuclei in the small volumes of the interdendritic fluid is unlikely. However, heterogeneous nucleation can happen during the later stages of freezing if there are small oxide particles present within the dendrite arms.

The driving force for gas pore formation is gas rejection as a result of the decrease of gas solubility in the metal as the temperature decreases during cooling and solidification. The rejected solute (atomic) gas accumulates in front of the liquid/solid interface and when it reaches a certain value of supersaturation, the molecular gas is evolved. Gas rejection is also influenced by the amount of solute additions since the solubility of gases in liquid metals changes as the amount of solute increases.

Usually, evolution of gases during solidification and failure to feed solidification shrinkage are closely related phenomena that lead to total porosity in alloy castings. "Pipe formation" is universally associated with solidification shrinkage; spherical "gas holes" are attributed to bubbles of gas; but the origin of microporosity of long freezing-range alloys, which usually exhibits an irregular or scalloped outline when viewed in cross section, remains a "subject of continuing debate".

In the formation of microporosity it is impossible to completely separate the effects of shrinkage and dissolved gas. If metal shrinkage is taken into account, gas pores in interdendritic channels will form at lower gas pressures. Fluid flow in the channels between dendrites to feed the solidification shrinkage and the metallostatic head at the dendrite tips, are the driving forces for the flow. The pressure continuously decreases within the channel because of frictional dissipation of energy. When the pressure in the liquid becomes less than the partial pressure of the dissolved gas, $P_g$, minus the pressure to overcome surface energy $2\gamma_{lv}/r_p$, a pore will form. The size of the pore depends on the volume fraction of shrinkage, liquid viscosity, rate of advance of dendrite tips and size of the mushy zone.

The two effects (gas porosity and solidification shrinkage) are additive.

The magnesium casting alloys are typically hypoeutectic and long freezing-range alloys, and solidify in a mushy manner. Therefore, they exhibit microporosity. The appearance of microporosity in magnesium alloys can be demonstrated by micrographs. Specifically, microporosity consists of small pores more or less interconnected to form colonies, the individual pores being visible only under a microscope, but the colonies may be visible with a naked eye on carefully machined, ground and polished sections. The individual pores usually lie between the grains, but may occur between the axes of the dendrites forming the grains. Shrinkage microporosity found in magnesium alloys is finer than in other long freezing-range alloys since most magnesium alloys are finer-grained than other cast alloys.

In a typical magnesium alloy fine microporosity is observed throughout most of the casting, but at the heat centers and within the riser the porosity tends to be somewhat coarser although still dispersed. In castings of well grain-refined magnesium alloys the microporosity tends to form layers which are particularly damaging to mechanical properties. This kind of porosity is sometimes known as layer porosity. Layer porosity has been observed in many different casting alloys—magnesium being one of them. Certain conditions favour its formation, which appears to be typified by low temperature gradients in the casting giving rise to a wide and more or less uniform pasty zone, which arises from several factors, particularly: (a) wide freezing range alloy, (b) high thermal conductivity of metal, (c) low thermal conductivity of mold, and (d) high mold temperature.

There have been many investigations to determine the primary causes of microporosity in magnesium alloys. It is generally established that microporosity in magnesium alloy castings is due essentially to solidification shrinkage, but it is also observed that dissolved hydrogen may aggrevate the problem.

The reduction of microporosity in long freezing-range alloys poses considerable difficulties, and involves (a) reduction of dissolved gases by degassing, and (b) reduction of solidification shrinkage by increasing feeding via proper risering and chilling.

A common method of degassing a magnesium alloy metal is by bubbling a suitable gas, such as chlorine, nitrogen or argon, through the melt. While the action of such a gas may be in part chemical, more probably such a fluxing material acts as a mechanical carrier; the dissolved gas in the melt desorbs on the bubble of the fluxing gas and is carried to the melt surface where it can escape. The degassing of magnesium alloys is usually achieved by chlorine gas treatment. Chlorine can also be introduced in the form of hexachlorethane ($C_2Cl_6$) tablets. It is possible to effectively eliminate gas porosity from magnesium alloys by proper degassing techniques.

The control of microporosity due to solidification shrinkage of long freezing-range alloys presents a much greater difficulty than the control of gas porosity. As mentioned before, in properly degassed magnesium alloy castings microporosity is mainly due to solidification shrinkage. The critical stage in its control is the final period of solidification, i.e., after the alloy is about 70 per cent solid and coherence has been established between the growing crystals. Mass feeding at this stage can no longer take place and it is not possible for the liquid feed metal to find its way from the riser (which itself is in a mushy condition by this time) down the tortuous interdendritic channels to all the many locations where freezing is taking place. About 2 per cent freezing shrinkage usually remains uncompensated at this point.

The most effective and conventional way of controlling shrinkage microporosity is to establish and maintain extremely steep temperature gradients, directed towards the riser, during solidification. In long freezing range alloys solidification takes place simultaneously throughout the casting. In order to ensure proper feeding of remote areas of the casting, when the remote areas of the casting are almost solid, solidification in and near the risers must be at an early stage.

Directional solidification (steep temperature gradients) is attained by designing the mold and by utilizing the intrinsic design of the casting. For instance, a thermal gradient of 2.8°K/cm produces sound Mg/Al/Zn alloy castings. This gradient is suitably established before the metal has cooled to more than 28°K below the liquidus. The establishment of the thermal conditions required to produce this condition is not difficult in thin-sectioned castings because rapid cooling at the edges and corners produces the desired effect. However, serious problems are experienced with thick-sectioned castings above 1.0 inches, and usually, the only way to produce high soundness is to severely chill a large area of the casting surface. In order to maintain directional solidification and steep thermal gradients over long distances, it is necessary to use the potent short range effect of chills by their suitable placement. This can be accomplished by using the chills in lateral rather than end positions. In this way, a smoothly decreasing effect of the chills along the section is created. Here, a double taper or wedge design is used to maximize the chilling effect.

The pore size in unidirectionally solidified long freezing alloys is significantly smaller than those same alloys solidified under conditions of low thermal gradient.

The levels of porosity are usually quantified by measuring the density of the cast alloy. Low amounts of porosity yield higher values of density and vice-versa.

BRIEF DESCRIPTION OF DRAWINGS

Particular features of the invention are illustrated by reference to the accompanying drawings in which:

FIGS. 8 to 10 are plots of density of a magnesium alloy casting against distance from chill for different Sr contents;

FIG. 13 is a density plot for risered cast bars of an Mg alloy at different Sr levels;

FIGS. 14 to 17 are cooling curves for an Mg alloy during solidification with different Sr levels.

EXPERIMENTAL

Figure 1:
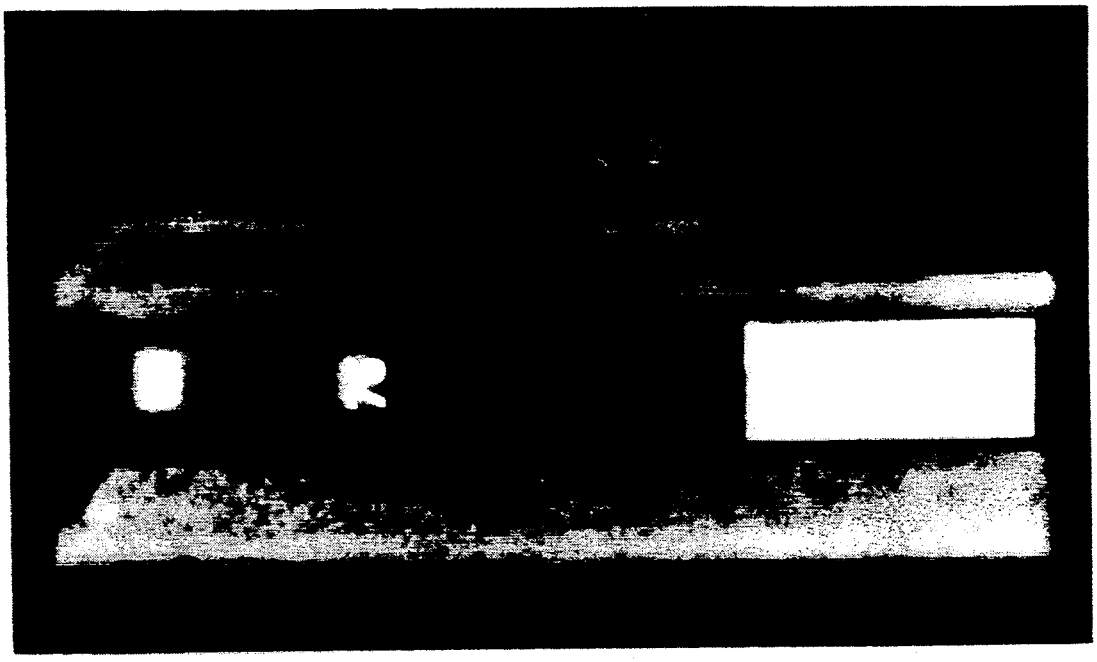
FIG. 1 is a photomicrograph showing the distribution of shrinkage microporosity in a magnesium alloy casting at 0% Sr level.

A number of experiments was designed and carried out in order to investigate the effect of strontium on the shrinkage microporosity of magnesium alloys of the AZ91 series. The first part of the experimental work which consisted of only melting and casting experiments was conducted in three groups:

1. Preliminary experiments to produce density and radiography test bar castings, and corrosion plates in order to study the pattern of shrinkage microporosity distribution at different strontium levels varying between 0% to 0.068% Sr.

2. Experiments to produce a risered and chilled bar casting in order to investigate the combined effect of the optimum level of strontium addition with enhanced directional solidification.

3. Experiments to produce tensile-test bar castings for studying the effect of the optimum level of Sr addition on the tensile and yield strengths and elongation of the alloy.

The remaining portion of the experimental work consisted of chemical analysis by atomic absorption spectrometry, thermal analysis, evaluation of shrinkage microporosity by X-ray radiography and density measurements, metallography and grain-size determination by SEM-based image analysis.

Casting Alloy

The AZ91 magnesium casting alloy used in these experiments was provided in ingot form by Timminco Metals Ltd. To keep the chemical composition of the alloy consistent throughout the experiments, all the ingots used were taken from the same production batch below:

| | |
|---|---|
| Al | 8.4%, by weight |
| Zn | 0.79%, by weight |
| Mn | 0.23%, by weight |
| Si | 0.01%, by weight |
| Cu | 0.001%, by weight |
| Ni | 0.008%, by weight |
| Others | 0.006%, by weight |
| Mg | balance. |

The AZ91 magnesium casting alloy used in these experiments was selected for several reasons:

It is one of the principal casting alloys which is used today, especially in commercial aerospace applications where cost is a major factor. This alloy has high tensile strength, good ductility, and moderate yield strength.

Castings in this alloy be readily produced via sand, investment, permanent mold casting and pres sure diecasting techniques.

This is one of the alloys which has the highest tendency to shrinkage microporosity.

Strontium Additive

The strontium additions were made as 90/10 (Sr/Al) binary master alloy supplied also by Timminco Metals Ltd. in the form of extruded bars, 18 mm in diameter. The chemical composition of 90/10 master alloy is given below:

| | |
|---|---|
| Sr | 88.20%, by weight |
| Fe | 0.05%, by weight |
| Na | 0.09%, by weight |
| N | 0.45%, by weight |
| Ca | 0.27%, by weight |
| Others | Mg=Ca=Ba~1.0% |

Grain-Refiner/Degasser

Hexachlorethane ($C_2Cl_6$) tablets were used as both grain refiner and degasser. Upon decomposition at the bottom of the melt carbon particles act as nucleants (for grain refining) while the rising chlorine gas bubbles degas the melt.

Protective Gas $SF_6/CO_2$ (sulphur hexafluoride/carbon dioxide) gas was used to create a protective atmosphere over the melt as a mixture of 0.6% $SF_6$ and the balance being $CO_2$.

Oil-tempered Molding Sand

For mold preparation a waterless, oiltempered molding sand (Petro Bond Sand) was used. This sand consists of a mulled mixture of fine silica sand, oil, bonding agent and a catalyst.

Silica Sand

Vitasil (Trade-Mark) Sand, a washed and dried silica sand with 99% silica content was used as the main ingredient in the molding mixture. This sand has less than 1% clay content and less than 0.25% moisture content. It has rounded grains with 135 AFS grain fineness number.

Oil

The oil used in the sand mixture was Petro Bond Oil. This is a petroleum based oil having an aromatic content of 10–20%, naphthenic content of 35 to 45%, paraffinic content 40–50%, a viscosity at 100° F. of 100 and a viscosity index $<52$.

Bonding Agent

A typical bonding agent is a dry powder made from bentonite by a chemical conversion and combined with heavy metallic oxides. The bonding agent used for the mold preparation was Petro Bond.

Catalyst

Methyl alcohol (methanol) was used as the catalyst. The catalyst increases the green strength of the molding sand.

Mold Coating

The prepared molds were spray-coated with Moldcote 825 supplied by Foseco Canada, Inc. Moldcote 825 is a zircon based coating in a methyl chloroform carrier. It is designed for use where rapid drying without heat is required. It is safe, nonflammable and gives excellent surface finish. This coating contains an inhibitor especially designed to inhibit reaction between molten magnesium and binders in sand systems.

Furnace Setup

The casting alloy was melted in a mild steel crucible (6 in in diameter and 7 in in height) which was placed in an induction furnace, Tocco Meltmaster, supplied by Tocco Induction Heating Division. The operating parameters of this threephase, medium-frequency (3000 Hz) induction furnace are 440 volts (60 Hz), 68 amps, 30 kw, and 30 kvar at 100% efficiency.

Since molten Mg alloys are very reactive in the normal atmosphere the furnace was covered with a protective steel hood to maintain an inert atmosphere over the melt. The inside of the steel hood was insulated with a thick layer of glass-wool to minimize the heat losses. The hood has a gas inlet made of copper tubing (0.2in diameter) and a viewing port that also accommodated a steel plunger for introducing strontium and hexachlorethane into the melt. A mixture of protective $SF_6/CO_2$ gasses was continuously introduced into the hood through the gas inlet at the flow rate of 5 liters/min. during melting and holding. The temperature of the melt was measured by K-type chromel-alumel thermocouples attached to a hand-held digital thermometer which was supplied by Omega Engineering, Inc.

Molding and Casting Equipment

Two different wooden patterns were used to produce the two sets of castings:

1. pattern for radiography bar-corrosion plate-density bar castings
2. pattern for risered and chilled casting.

EXPERIMENTAL PROCEDURE

Molding Sand Preparation

The molding sand was prepared in a conventional vertical wheel muller (Simpson Mix-Muller). The mulling procedure used in preparing the Petro Bond Sand is given below:

1. 51b of Petro Bond (bonding agent) was added into 1001b of dry Vitasil sand and this was mixed dry in the muller for about 1 minute.
2. 21b (1 liter) of oil was added to the mix in the muller and the mulling was continued for about 10 more minutes.
3. 50 ml of methyl alcohol was added as catalyst and the mixing was carried out for 3 to 5 minutes longer.

This sand can be kept indefinitely after mulling, and can be recycled and reused without further mulling.

Mold Preparation

The molds were prepared by using the Petro Bond sand, wooden patterns, graphite chills, aluminum pop-off flasks, dust bag, sand spoon, pneumatic rammer, trowels, lifters, straight edge, spray-gun and steel vent wire.

The molds were prepared 24 hours before pouring the metal by molding the Petro Bond sand in aluminum flasks by use of the patterns. The graphite chills were placed on the pattern board, when needed, at the end which is opposite to the location of the gates. The matchplate pattern was dusted with talc powder for easy separation, and the sand which was scooped from the muller was rammed over the pattern with the pneumatic rammer. Then, the pattern was stripped from the mold, and both halves of the mold were spray-painted with Moldcote 825 (Trade-Mark) and were left open to dry in the air. Further drying was carried out with a propane hand-torch for about 5 minutes on each half, and vent holes were opened in the upper mold (cope) with the vent wire. Finally, the upper mold (cope) was turned over and closed over the lower half (drag) in order to produce the castings in the mold cavity.

Melting

Melts of 5–7.51bs of the magnesium alloy were prepared in the Tocco induction furnace lined with a steel crucible. The charge material was prepared by sawing the alloy ingots into smaller pieces in order to pack them tightly in the crucible for the maximum furnace efficiency. These pieces were chemically and mechanically cleaned, and dried before charging them into the furnace crucible to prevent the introduction of any dust, grease or moisture. To avoid the oxidation and burning of the alloy, $SF_6/CO_2$ gas mixture was continuously introduced at the rate of 5 liters/min. as soon as the furnace temperature reached 350° C. The complete melting of the alloy occurs at 650° C. The melt temperature was increased to 740° C. and the melt was grain-refined and degassed by immersing a calculated and fixed amount (0.25%, by weight) of hexachlorethane tablets with the steel plunger for 2.5 minutes. Predetermined amounts of 90/10 Sr master alloy were cut and prepared by wrapping them in Al foil. When required, these were added to the melt with the steel plunger at 740° C. and dissolved by slowly moving it for 2.5 minutes at the bottom of the melt. A chemical analysis sample was taken from the melt, 5 minutes after the last addition, for atomic absorption analysis of the Sr levels. Finally, the molten metal was poured into the prepared molds at 760° C.

Thermal Analysis Experiments

Thermal analyses (cooling curve tests) were carried out in order to investigate the effect of strontium on the liquidus arrest portion of the cooling curve of the magnesium alloy.

For each test magnesium casting alloy was melted in the induction furnace. The melts were either treated with strontium at 740° C., or left untreated, and the melt temperature was increased to 810° C. for pouring. The cooling curve samples were taken in thin-walled mild steel crucibles. A K-type (chromel-alumel) thermocouple with a stainless steel protective sheath was dipped into the center of the liquid alloy in the crucible. The thermocouple was connected via a terminal box to a computer-based temperature-data acquisition system which consisted of a microcomputer and a plug-in interface board. The acquired temperature data was manipulated and the cooling curves were plotted by the use of a spread-sheet software package, Lotus 1-2-3.

X-Ray Film Radiography

X-ray radiography was used to investigate the shrinkage microporosity distribution in the cast bars. Since it was difficult to detect fine shrinkage microporosity radiographically in magnesium castings several precautions were taken to increase the sensitivity such as:

The surfaces of the casings facing both the X-ray source and the film were machined on a milling-machine to a uniform thickness.

A fine-grain film of high contrast was used.

An x-ray unit of fairly low power was used together with longer exposure times.

The castings were radiographed by Robert Mitchell, Inc., Montreal and the parameters used are given in Table 2 below:

TABLE 2

X-ray radiography parameters for Mg castings

| Cast Bars | Thickness of bars (in) | Film Type | Power Current (KV) | Power Current (MA) | Exposure (min) | Source-Object Distance (in) |
|---|---|---|---|---|---|---|
| Density & Radiography | 4/5 | Kodak #1(M) | 50 | 8.0 | 7 | 72 |
| Risered & Chilled | 1.5 | Kodak #1(M) | 80 | 8.0 | 5 | 72 |

Density Measurement

The actual densities of the density test bar and the risered-and-chilled bar castings were determined, by using the Archimedes Principle, to quantify the existing shrinkage microporosity distribution. The principle involves the weighing of the casting in two different media (in this case, air and distilled water). The difference between the two measurements determines the volume of the casting. The casting weight when divided by its volume yields the density of the casting, and comparing this with the theoretical maximum density for the alloys gives the porosity for the casting.

Both the density test bar and the risered-and-chilled bar castings were sectioned tranversely into ten equal pieces. Density measurements were carried out individually on each piece. In order to avoid the adsorption of air bubbles onto the sample surface, a wetting agent Teepol (Trade-Mark) was added to the water to reduce surface tension.

Metallography

Metallographic samples were cut from the castings and mounted by using a cold-setting epoxy resin and hardener mixture Quickmount (Trade-Mark). The grinding was carried out on silicon carbide papers of decreasing grit size (120, 240, 400 and 600) on a rotating disc. After ultrasonic cleaning, rough polishing was carried out on a cloth-covered rotating wheel by use of a slurry of 5 μm alumina powder. For final polishing 0.3 μm alumina powder slurry was used. Samples were etched in aceticpicral (5 ml acetic acid, 6 g picric acid, 10 ml distilled water, 100 ml ethanol) to reveal the grain boundaries of the as-cast microstructure. Nital (2 ml nitric acid, 100 ml methanol) was also used for general microstructural studies.

Grain Size Determination by SEM Based Image Analysis

Since the as-cast microstructure of the magnesium alloy castings exhibits grain boundaries which are indistinct and widely masked by the eutectic compound, it was not possible to measure the grain size without subjecting the image to a certain amount of grain boundary reconstruction by image processing. Therefore, an SEM based semiautomatic image analysis technique was the best way to determine the grain size distribution.

Samples were examined using a scanning electron microscope (SEM), JSM-840A, at a working distance (WD) of 39 mm, an accelerating voltage of 25 kV, and a probe current of $1\times10^{-8}$ microamperes. Both qualitative observations and image acquisition were made using the secondary electron imaging (SEI) mode.

Since the grain structure within a sample may vary to some extent with position, five fields were observed on each sample and five field images were captured in order to arrive at a statistically reliable result. A well-defined grey-level image can make all the subsequent processing simpler, faster and more precise. Consequently, a fairly good image was obtained on the microscope's CRT screen. Then, a video image was obtained on the image monitor of the TN-5700 Image Analyzer, and the main image parameters were set for the acquisition step. The parameters which were entered into the image analyzer using the IPA 57 Image Processing and Analysis Program were:

Microscope magnification: 100 (standard magnification for most grain size measurement methods)
Video input signal: 1 (for SEI)
Pixel acquisition clock: 150 (scan rate; higher the number, the slower the scan rate which is a requirement for acquiring a good image)
Image size (pixels): 512×512
Type of frame averaging: Kalman (provides the optimum image improvement; since each frame is weighted equally, the image will improve continuously for each new frame acquired)
Number of frames averaged: 5.

The acquired grey-level image was subjected to a smoothing operation by the use of a low-pass local averaging filter (smooth-average, size: 7×7), in order to reduce electronic noise, and eliminate erratic points. The enhanced grey image was converted into a binary image by setting thresholds (segmentation) in the grey-level intensity histogram. The yellow region in the histogram was moved and adjusted to select the portion of the grey-level image that would appear in the binary. The result of this is the grey-level image overlayed with the current binary image of the grain boundaries that appears in yellow.

The acquired binary image exhibited very thick and incomplete grain boundaries. Since such thick grain boundaries would have given inaccurate values in sizing the areas of the grains, the binary image was thinned down to one pixel width, still leaving the boundaries intact, by use of the skeleton filter in the 8500 mode. The grain boundary reconstruction was carried out manually in the editing mode: first, the debris that lay within the grains were removed, and then the missing grain boundaries were drawn in both by use of an opto-mechanical mouse. The binary image was then inverted using a logical not operation (not binary), leaving separate grains.

The grain size analysis was performed on this last binary image using the IPA 57 Image Analysis Program. The individual grains measured by the system were automatically numbered and randomly assigned a color. A summary of the analysis results was printed by the system printer.

Since the IPA 57 program could perform grain size analysis for one field (image) at a time, the data for different fields were stored on floppy diskettes and manipulated with a more powerful data-base management program, Techcalc. Using this program all 5 data-base files representing the data acquired over 5 fields for each sample were linked together. After averaging the linked data for each sample, a table of averaged data results was produced.

RESULTS

Preliminary Experiments

The preliminary melting and casting experiments were carried out to investigate the effect, if any, of adding different levels of strontium, on microporosity. To this end, density and radiography bar castings were produced at the following Sr levels:

0% Sr
0.013% Sr
0 016% Sr
0.018% Sr
0 038% Sr
0.050% Sr
0.068% Sr

In order to study the microporosity distribution qualitatively, the bars were radiographed at each strontium level using x-ray film radiography. Since all the melts were well-degassed, the microporosity observed in these castings can be attributed solely to solidification shrinkage.

Figure 2:
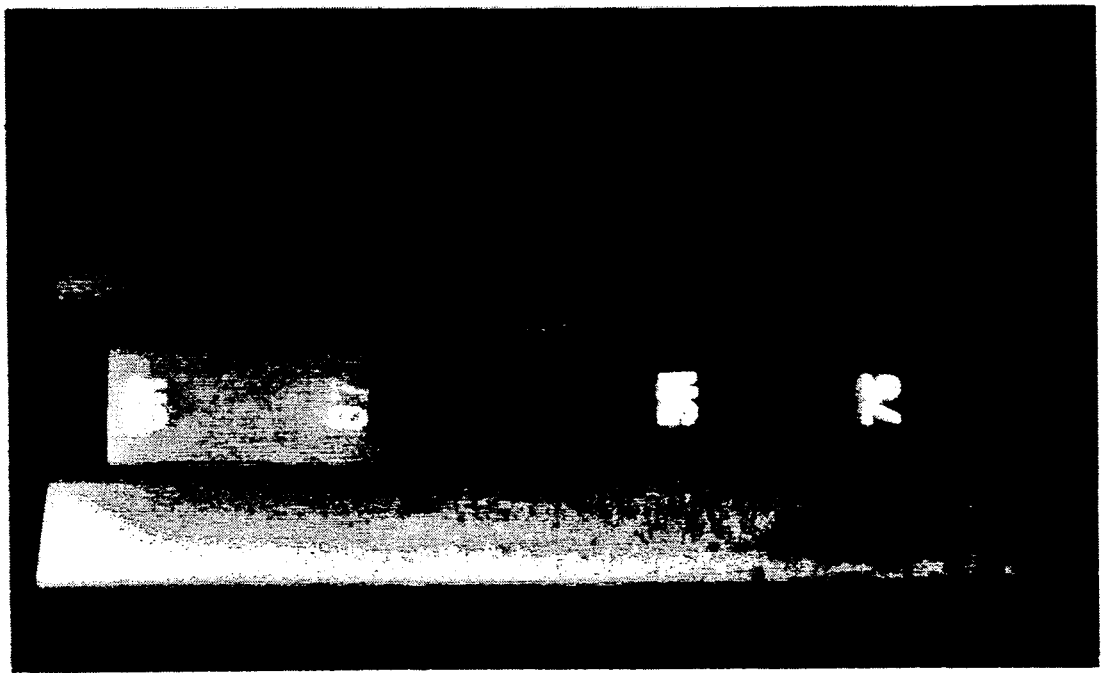
FIG. 2 is a photomicrograph similar to FIG. 1, at 0.013% Sr level.
Figure 3:
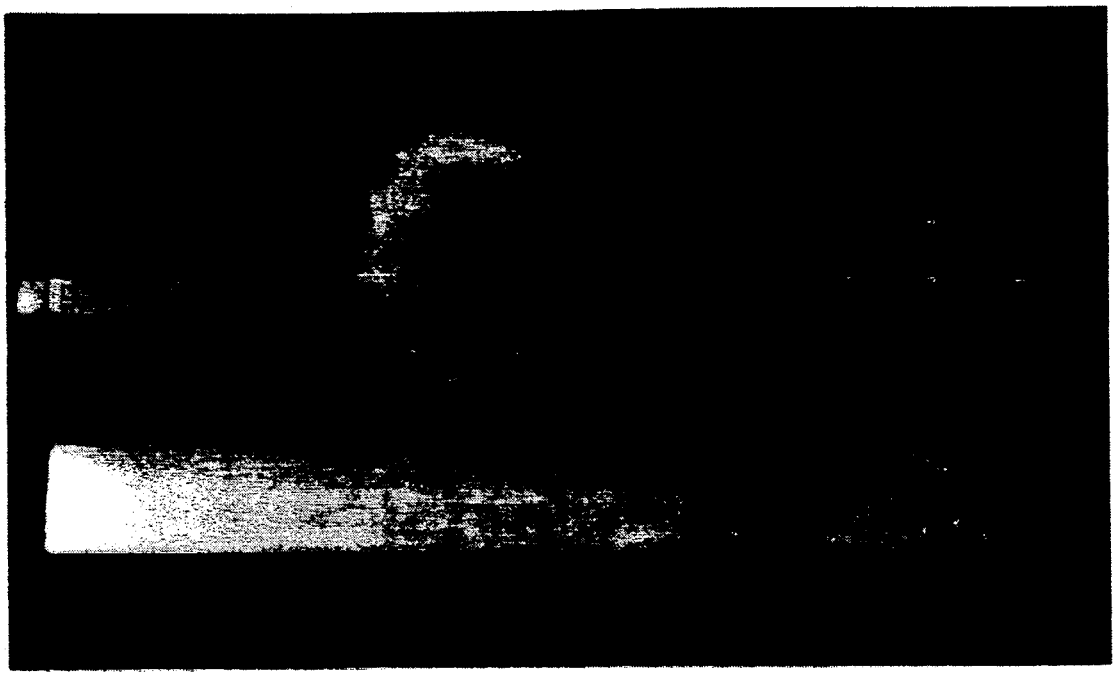
FIG. 3 is a photomicrograph similar to FIG. 1, at 0.016% Sr level.
Figure 4:
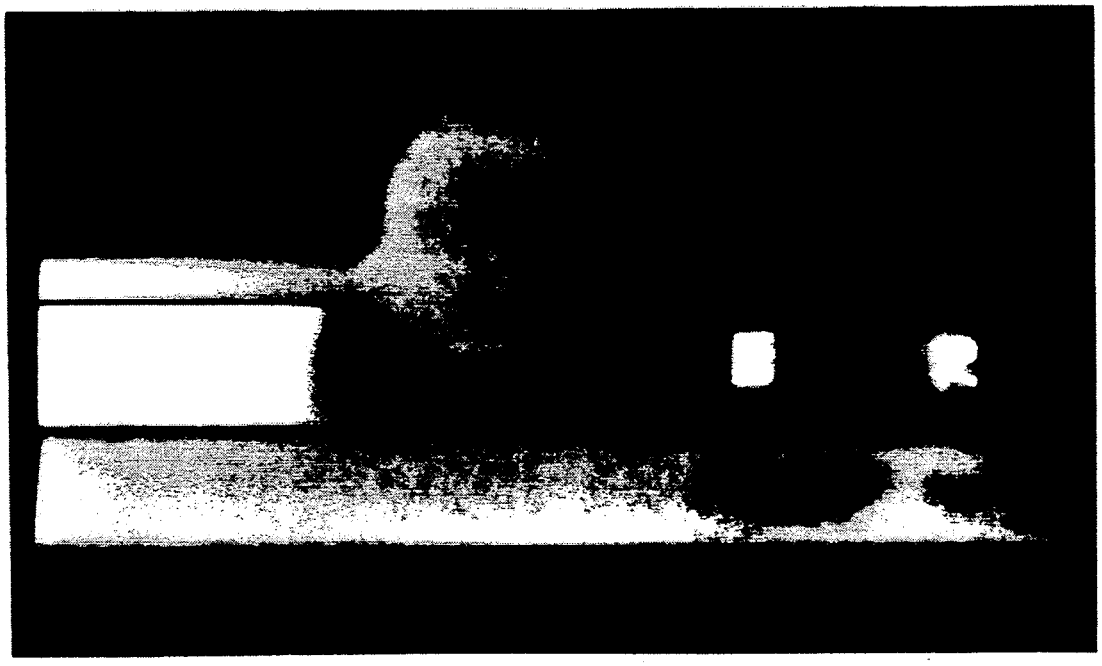
FIG. 4 is a photomicrograph similar to FIG. 1, at 0.018% Sr level.
Figure 5:
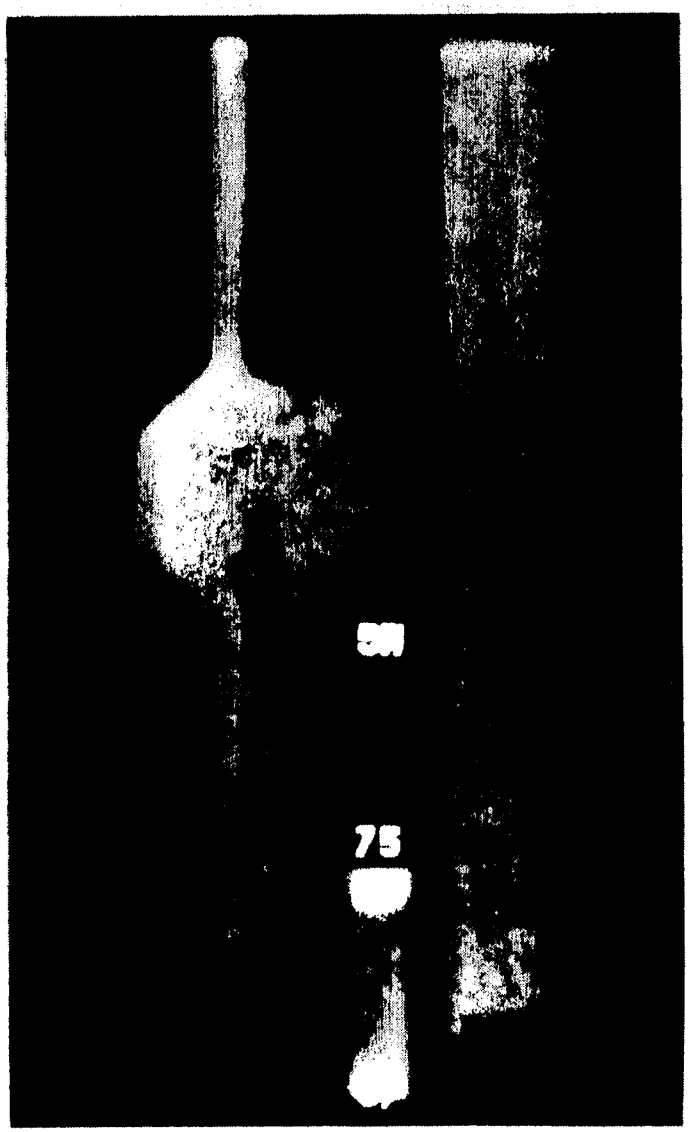
FIG. 5 is a photomicrograph similar to FIG. 1, at 0.038% Sr level.
Figure 6:
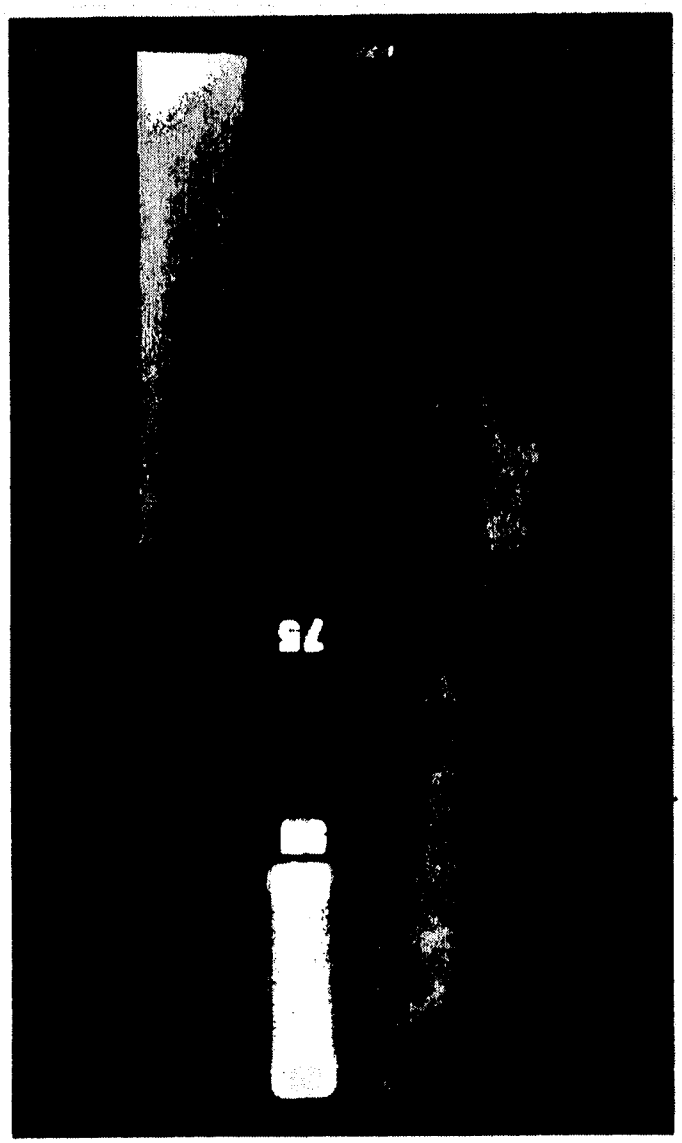
FIG. 6 is a photomicrograph similar to FIG. 1, at 0.050% Sr level.
Figure 7:
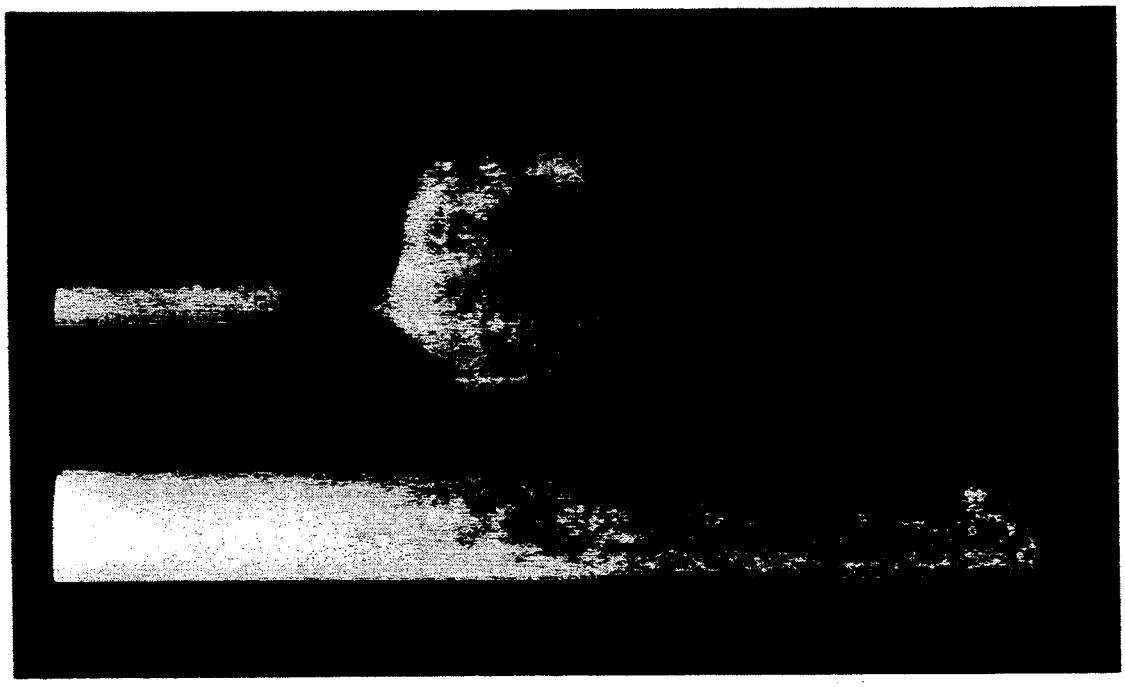
FIG. 7 is a photomicrograph similar to FIG. 1, at 0.068% Sr level.
Figure 11:
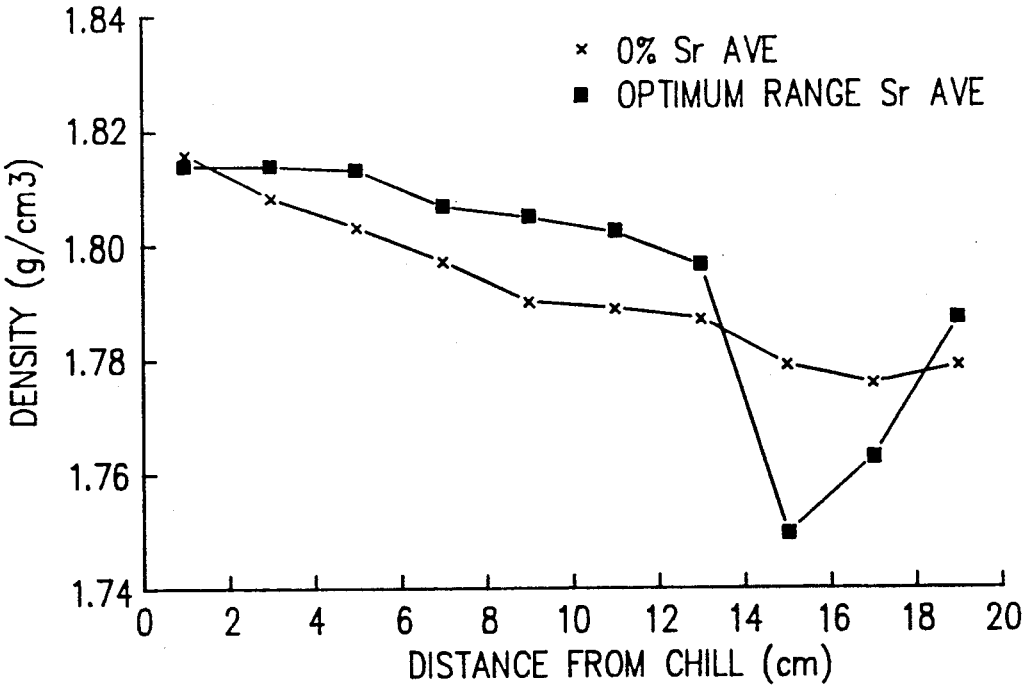
FIG. 11 is a summary plot from the average values of Sr level in FIGS. 8 to 10.

At 0% Sr level, as seen in FIG. 1, shrinkage microporosity in both the density and the radiography test bars is well-dispersed throughout the entire casting. However, with the addition of 0.014% Sr a considerable amount of microporosity is concentrated in colonies at the hottest sections, even though some dispersed porosity still exists (FIG. 2). The hottest spot (a) in the radiography test bar is at the junction of the octagonal section and larger rectangular section, and (b) in the density test bar it is located near the gate. As the strontium level is increased to 0.016%, the amount of dispersed porosity is decreased while the size and density of the porosity concentration are considerably increased (FIG. 3). At a Sr level of 0.018% maximum microporosity concentration takes place (FIG. 4). However, at a higher Sr level of 0.038% this effect has partially disappeared (FIG. 5). At still higher Sr levels (0.05% and 0.068%) this concentration effect is no longer observed (FIGS. 6 and 7). At these high Sr concentrations microporosity is again finely dispersed throughout the test bars as in the case of Sr concentration.

After radiographic examination, the sandcast density test bars were sectioned transversely into ten equal pieces of 2 cm each (section 1 being the one closest to the graphite chill), and density measurements were carried out individually on each piece. For these density test bars, the density values were plotted as a function of distance from the graphite chill (FIGS. 8 to 11).

FIG. 8 shows the density curves of bars at different strontium concentrations.

At 0% Sr, density decreased continuously from the chilled end, and after making a small dip at the hot spot it shows a slight increase at the far right end. This means that microporosity is dispersed throughout the cast bar.

2. At 0.013% Sr level, the density is considerably higher throughout the most of the bar, but shows a sharp decrease at the hot section.
3. At the level of 0.018% Sr, the bar exhibits much higher density except at the hottest section where it has a sharp dip. This agrees well with the radiograph of the bar (FIGS. 8 and 10) that microporosity has been concentrated at the hottest section.
4. At 0.05% Sr, however, even though the bar exhibits higher density in the first one-third, this trend suddenly disappears for the remaining portion, and the curve is similar to the 0% Sr curve.

These experiments were repeated to confirm the reproducibility of the results. The density curves plotted for five test bars (all at 0% Sr) exhibit the same pattern of gradual decrease in density as the distance from the chilled end increases (FIG. 9). The consistent effect obtained at the optimum level of Sr (0.016% Sr and 0.018% Sr) is given in FIG. 10 which indicates a sharp drop in density in the hottest section only. The average values of the five 0% Sr and the two optimum-range Sr concentrations are plotted (FIG. 11) as a summary graph.

Consequently, it can be observed that there is a good agreement between the results of density measurement and the x-ray radiographs. Therefore, the effect of strontium on sand-cast bars of AZ91 alloy can be summarized as follows:

1. Sr alters the distribution of shrinkage microporosity in AZ91 alloy sand castings within the range of 0.005%–0.03%, especially 0.01%–0.02% Sr.
2. Within this optimum range microporosity is concentrated in the hottest part of the castings.

Directional Solidification Experiments

Figure 12:
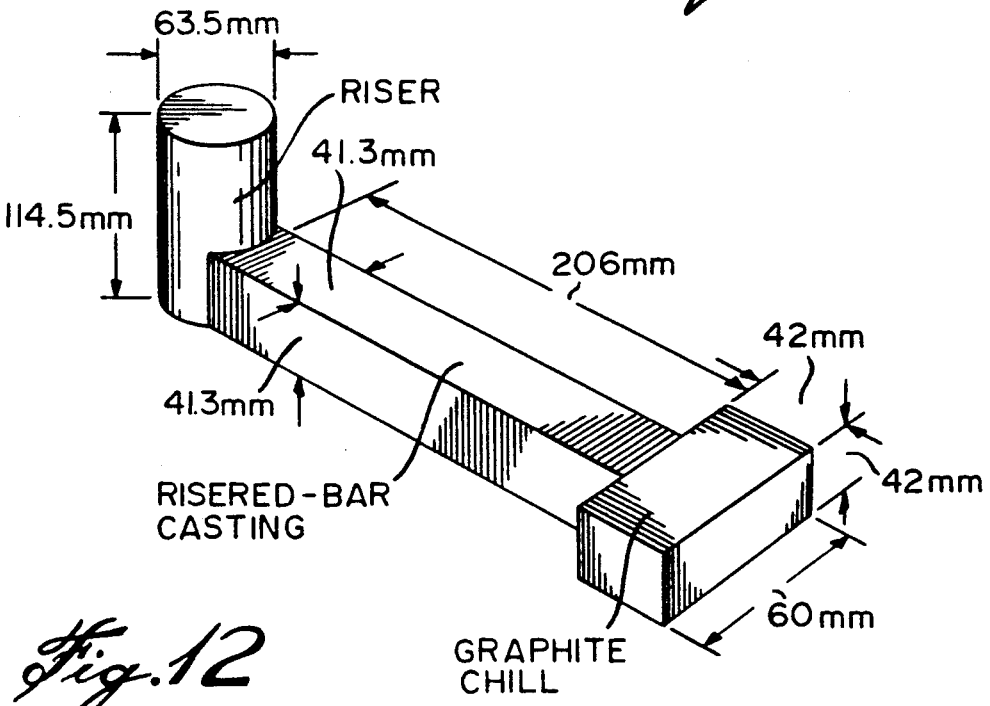
FIG. 12 is an illustration of a risered and chilled bar casting employed in the directional solidification experiments.

The preliminary experiments identified that additions in the range of 0.005%–0.03%, especially 0.01%–0.02% Sr concentrate microporosity at the hottest spot. The second stage of the investigation was to study the combined effect of Sr additions with enhanced directional solidification in castings. To this effect a heavy-sectioned risered bar casting was designed (FIG. 12).

This casting was designed in such a way that a temperature gradient would be created between the riser and the farthest end of the bar. Consequently, the hottest spot would be located inside the riser. This leads to the fact that at optimum level of Sr additions shrinkage microporosity would be forced into the riser which forms an appendix having no useful function after the casting is solidified, and which is subsequently removed. To make the temperature gradient steeper when necessary, a graphite end-chill was also incorporated into the mold.

Directional Solidification with no End-Chills

For each set of experiments, two separate AZ91 alloy melts were prepared (from the same ingot to avoid compositional variation) and a total of two bars were cast, one from each melt. One bar was cast at 0% Sr and the other at an Sr concentration of 0.014%. Subsequently, these bars were machined to a uniform thickness and radiographed by using x-ray film radiography. Radiographs of both the risered and the risered and chilled bars cast at 0% Sr and 0.014% Sr concentrations were taken.

In the first set of experiments where the graphite end-chills were not incorporated the temperature gradient was not very steep, and the bar cast at 0% Sr concentration exhibits dispersed porosity throughout the entire length of the bar while in the bar cast at 0.014% Sr some porosity was shown to be driven into the riser.

Directional Solidification with End-Chills

When the end-chills were incorporated in the second set of experiments, the effect was quite different. The bar at 0% Sr still exhibited severe microporosity throughout (except at the chilled end), and also shrinkage-related internal hot tearing. However, the bar at 0.014% Sr had all the porosity driven into the riser and thus yielded a sound bar substantially free of microporosity.

Density Measurements of Risered Castings

After the radiography tests, these bars were sectioned transversely into ten equal pieces of 2 cm each, section #1 being the closest to the farthest end from the riser and/or graphite chill, and density measurements were carried out individually on each piece. For these sandcast bars, the results of the density measurements were plotted as a function of distance either from the farthest end opposite to the riser or the graphite chill. X-ray radiographs of these pieces were also taken to show the change in microporosity concentration.

The density plots of the bars cast without the end-chills show that 0.014% Sr addition yields a higher density casting than that of 0% Sr (FIG. 13). Radiographs of the transverse sections of these two castings confirmed this result.

However, when end-chills are used together with the optimum level of 0.014% Sr, a sound casting with constant density is produced, and shrinkage microporosity is completely driven into the riser as demonstrated by the sharp drop in the density of the riser. On the other hand, at 0% Sr concentration, use of a chill and a riser alone cannot produce a sound casting. These results were visually confirmed by radiographs of the transverse sections of the two castings.

There is a good agreement between the results of density measurements and the x-ray radiographs.

Investigation of Mechanism

The first step of the investigation to elucidate the mechanism of the effect of Sr on the redistribution of shrinkage microporosity in Mg alloy castings was a study of the macro- and microstructure.

In the macrostructural investigation the distribution of shrinkage microporosity in Mg alloy bar castings containing 0%, 0.018% and 0.05% Sr, respectively was examined.

In the case of 0% Sr the section from the middle of the bar and the section from the hottest spot both exhibited dispersed and rather coarse integranular type shrinkage microporosity. The hottest spot exhibited a slightly more and coarser microporosity.

In the case of 0.018% Sr the middle section of the bar had a very reduced level of microporosity which occurred in isolated pockets, while the hottest section had a very high concentration of coarse microporosity. This agrees with the density measurement. Furthermore the grain size, as delineated by microporosity network around the grains, in both sections appears to be smaller than the corresponding sections at 0% Sr.

In the case of 0.05% Sr the sections from the middle of the bar exhibited microporosity more than that of the 0.018% level of Sr and less than at 0% Sr. The grain size appeared much coarser and the shrinkage microporosity was much finer, especially in the hottest section.

Microstructural investigation shows the microstructure of the Mg alloy with 0% Sr showing the $Mg_{17}Al_{12}+\alpha$-(Mg) eutectic configuration. Globules of $\alpha$-(Mg) are imbedded in the $Mg_{17}Al_{12}$ phase to form the main part of the eutectic. There is also $Mg_{17}Al_{12}$ compound which has precipitated from the solid solution to form a pearlitic type of precipitate at the grain boundaries, and sometimes a fine Widmanstatten type precipitate within the $\alpha$-(Mg) grains.

Microstructures of the Mg alloy at 0.018% Sr and 0.068% Sr levels, are similar to that of 0% Sr, except that in some cases the absence of the Widmanstatten precipitate can be noted.

Widmanstatten precipitates are platelike and needlelike precipitates which grow in such a manner that they are aligned along specific crystallographic planes or specific directions of the matrix crystals. The absence of the Widmanstatten precipitate with Sr additions to the Mg alloy may be explained by the poisoning of such planes and directions by Sr, which may preferentially attach itself to those planes.

Thermal Analysis and Grain Size Effect

Thermal analysis tests were carried out on the Mg melts at both 0% Sr and at 0.018% Sr in order to see if there was any difference in the cooling curves (liquidus and solidus arrests, supercooling, freezing point depression, etc.) with the addition of Sr. The typical cooling curves of these test samples 1, 2, 3 and 4 are given in FIGS. 14, 15, 16 and 17. No difference is observed with respect to the temperature of the liquidus and solidus. However, a major difference is observed in the degree of supercooling at the liquidus arrests. This difference in supercooling can be attributed to the degree of grain refinement in the casting.

Figure 18:
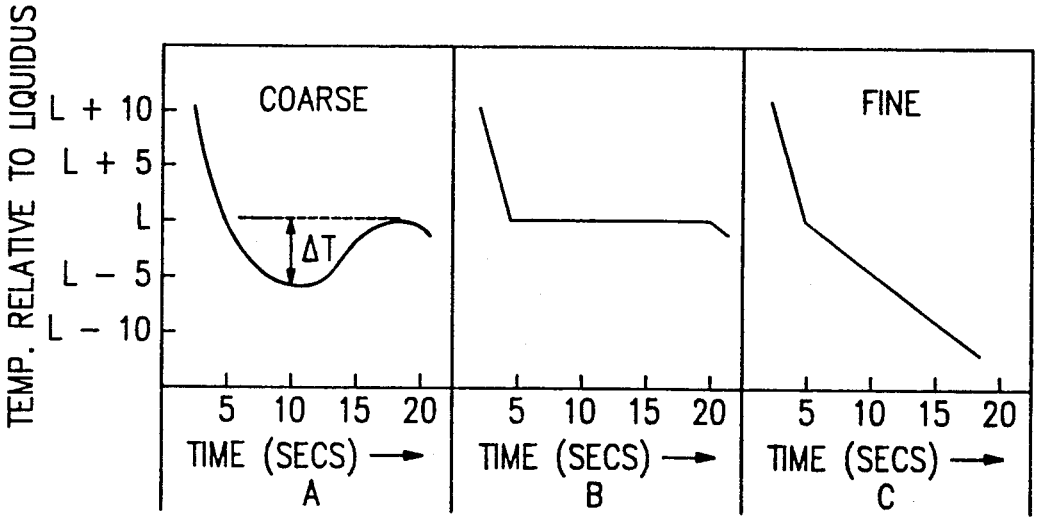
FIG. 18 illustrates diagrammatically the relationship between the cooling-curve liquidusarrests and grain size of the cast Mg alloy.

The cooling-curve test is known to give an indication of the expected grain size in alloy castings poured from a given melt. As seen from the three cooling-curve liquidus arrests in FIG. 18, a melt which will give coarse grains shows supercooling ($\Delta T$ in FIG. 18); a melt that will give fine grains exhibits no supercooling (FIG. 18); and for a melt that will yield medium-to-coarse grains, the liquidus arrest does not deviate from the horizontal (FIG. 18).

It appears that if nucleation of the grains in a solidifying liquid alloy is difficult due to an absence of heterogeneous nuclei, then the melt will supercool until appropriate nuclei form. Once the nucleation occurs, the melt temperature will increase and grain growth will occur at the normal equilibrium temperature. By the addition of nucleants (i.e. grain-refiners), both the nucleation rate and the number of nuclei will increase, and hence, no supercooling will be exhibited by the cooling curve while the casting acquires a fine-grained structure.

At 0% Sr (Sample 1) as seen in the enlarged liquidus-arrest portion of the cooling curve (circled region in FIG. 14), the alloy exhibits more than 0.6° C. of supercooling (FIG. 15). This would predict a coarse grained structure. On the other hand, at a 0.013% Sr concentration (Sample 2), in the enlarged portion of the cooling curve the alloy does not exhibit any supercooling (see enlarged section of the cooling curve circled in FIG. 16), but it extends smoothly downward in temperature at a substantially reduced slope from the preliquidus portion (FIG. 17). In this case, a fine-grained structure is expected.

A second set of tests was conducted in order to confirm the reproducibility of the results obtained from the first set. For Sample 3 (at 0% Sr concentration), the enlarged liquidus-arrest portion again shows more than 0.6° C. of supercooling. However, for Sample 4 (at 0.01% Sr concentration), the enlarged liquidus-arrest portion exhibits a slight supercooling of 0.018° C. which is in good agreement with the Sr concentration.

Determination of Grain Size

To verify the findings of thermal analysis, an SEM-/Image Analysis technique was used in order to determine the grain size distribution of Samples 1 and 2. The measured images of Samples 1 and 2 show that Sample 1 which exhibited a large supercooling has a much coarser grain structure than Sample 2 that yielded no supercooling at all. The results of the grain-size analyses for Samples 1 and 2 are given in Tables 3 and 4.

The results of the grain-size analyses indicate that Sample 1, cast from an untreated melt exhibited a coarse grain structure (250.3 $\mu$m average grain size) while Sample 2, cast from a melt treated with the 0.013% Sr, has a very fine-grained structure of 121.4 um average grain size.

TABLE 3

Average parameter values for 85 grains on Sample 1. (0% Sr)

| | | |
|---|---|---|
| Area ($\mu m^2$) | 38797.3 | +/− 33240.4 |
| Perimeter ($\mu m$) | 1179.2 | +/− 883.7 |
| Shape Factor | 2.442 | +/− 1.873 |
| Y Minimum (p × 1) | 154 | +/− 144 |
| Y Maximum (p × 1) | 295 | +/− 149 |
| X Minimum (p × 1) | 188 | +/− 153 |
| X Maximum (p × 1) | 324 | +/− 154 |
| X center (p × 1) | 247 | +/− 151 |
| Y center (p × 1) | 255 | +/− 143 |
| X-Feret ($\mu m$) | 243.1 | +/− 136.9 |
| Y-Feret ($\mu m$) | 238.1 | +/− 105.7 |
| Average Diameter ($\mu m$) | 250.3 | +/− 105.1 |
| Length ($\mu m$) | 394.8 | +/− 131.9 |
| Width ($\mu m$) | 179.6 | +/− 84.6 |
| Aspect Ratio | 1.8 | +/− 0.7 |
| Orientation (deg) | 70.352 | +/− 52.336 |

TABLE 4

Average parameter values for 333 grains on Sample 2. (0.013% Sr)

| | | |
|---|---|---|
| Area ($\mu m^2$) | 9691.2 | +/− 7847.1 |
| Perimeter ($\mu m$) | 466.7 | +/− 403 |
| Shape Factor | 1.833 | +/− 1.167 |
| Y Minimum (p × 1) | 195 | +/− 138 |
| Y Maximum (p × 1) | 264 | +/− 139 |
| X Minimum (p × 1) | 225 | +/− 155 |
| X Maximum (p × 1) | 296 | +/− 151 |
| X center (p × 1) | 259 | +/− 153 |
| Y center (p × 1) | 229 | +/− 138 |
| X-Feret ($\mu m$) | 121.4 | +/− 61.3 |
| Y-Feret ($\mu m$ | 118.4 | +/− 51.2 |
| Average Diameter ($\mu m$) | 121.3 | +/− 50.5 |
| Length ($\mu m$) | 145.9 | +/− 63.8 |
| Width ($\mu m$) | 92.9 | +/− 39.6 |
| Aspect Ratio | 1.6 | +/− 0.4 |
| Orientation (deg) | 73.933 | +/− 52.484 |

We claim:

1. A method of producing a cast magnesium alloy part characterized by a low microporosity comprising:

adding strontium to a molten melt of a magnesium alloy in an amount effective to concentrate the microporosity of the alloy on casting, casting said melt and shifting the concentrated microporosity to an appendix of the desired cast part, and removing the appendix with said concentrated microporosity.

2. A method according to claim 1, wherein said amount of strontium is from 0.001 to 0.1%, by weight, of said melt.

3. A method according to claim 1, wherein said amount of strontium is from 0.005% to 0.03%, by weight, of said melt.

4. A method according to claim 1, wherein said amount of strontium is from 0.01% to 0.02%, by weight, of said melt.

5. A method according to claim 1, in which said casting comprises die-casting said melt.

6. A method according to claim 1, in which said casting comprises sand casting said melt.

7. A method according to claim 1, in which said magnesium alloy contains in wt. %: 4 to 10% Al, 0.5 to 6% Zn, 0 to 0.15% Mn, 0 to 3.5% rare earth elements, 0 to 3.5% Th, 0 to 6% Y, 0 to 1% Zr and 0 to 1% Si, the balance being magnesium.

8. A method according to claim 1, wherein said magnesium alloy comprises alloying amounts of aluminum, zinc and manganese.

9. A method according to claim 3, in which said casting produces a fine grain size in said cast part in the range of 75 to 150 $\mu m$.

10. A method according to claim 3, in which the step of casting comprises contacting the melt with at least one cooling surface and solidifying the melt in a direction away from the at least one cooling surface to effect concentration of microporosity remote from the at least one cooling surface.

11. A method according to claim 9, including a step of degassing said melt prior to said casting.

12. A method according to claim 8, in which said magnesium alloy contains about 8% aluminum, about 0.7% zinc and about 0.13% manganese, in weight %, based on the weight of the alloy, the balance being magnesium.

13. A method according to claim 10, in which a cast part is produced from said step of casting, said cast part comprising a main part and said appendix, the concentration of the microporosity being in said appendix, and including a step of removing said appendix.

14. A cast magnesium alloy part characterized by microporosity of less than 0.75%, by volume, and containing in wt. %: 4 to 10% Al, 0.5 to 6% Zn, 0 to 0.15% Mn, 0 to 3.5% rare earth elements, 0 to 3.5% Th, 0 to 6% Y, 0 to 1% Zr and 0 to 1% S; and a content of strontium of 0.0001 to 0.1%, by weight, based on the weight of the alloy part, the balance being magnesium.

15. A cast magnesium alloy part of claim 14, wherein said alloy contains, in weight %, about 8% aluminum, about 0.7% zinc, about 0.13% manganese, said strontium and the balance being manganese.

16. A cast magnesium alloy part of claim 14, further characterized by a microporosity of less than 0.5% by volume.

17. A cast magnesium alloy part of claim 14, in which said content of strontium is 0.005 to 0.03%, by weight, based on the weight of the alloy.

18. A cast magnesium alloy part of claim 14, in which said content of strontium is 0.01 to 0.02%, by weight.

19. A cast magnesium alloy part of claim 14, further characterized by a fine grain size of 75 to 150 $\mu m$.

* * * * *